United States Patent [19]

Eckerle

[11] Patent Number: 4,608,757

[45] Date of Patent: Sep. 2, 1986

[54] DOUBLE ENDED THROWING KNIFE

[76] Inventor: Douglas W. Eckerle, 1310 N. Daisy, Escondido, Calif. 92027

[21] Appl. No.: 722,726

[22] Filed: Apr. 11, 1985

[51] Int. Cl.[4] ..... B26B 3/00

[52] U.S. Cl. ..... 30/299; 30/162; 30/152

[58] Field of Search ..... 30/299, 152, 153, 162, 30/360, 312; 7/113, 118

[56] References Cited

U.S. PATENT DOCUMENTS

| | | | |
|---|---|---|---|
| 373,580 | 11/1887 | Boynton . | |
| 766,059 | 7/1904 | Palmer | 30/153 |
| 821,176 | 5/1906 | Leland . | |
| 972,305 | 10/1910 | Whittemore | 30/299 X |
| 1,200,079 | 10/1916 | Christensen et al. | 30/153 X |
| 1,357,398 | 11/1920 | Haywood . | |
| 1,748,637 | 2/1930 | Crum | 30/162 |
| 1,940,855 | 12/1933 | Friedman | 30/9 |
| 2,343,175 | 2/1944 | Evinger | 30/161 |
| 2,441,475 | 5/1948 | Di Veglia | 30/299 |
| 2,507,019 | 5/1950 | Johnson | 30/151 |
| 2,611,178 | 9/1952 | Whipple et al. | 30/162 |
| 2,820,291 | 1/1958 | Philippar | 30/153 |
| 3,025,598 | 3/1962 | Nissen | 30/162 |
| 3,171,201 | 3/1965 | Carifi | 30/335 |
| 3,906,626 | 9/1975 | Riuli | 30/162 |
| 4,265,017 | 5/1981 | Collins | 30/162 |
| 4,322,885 | 4/1982 | Osada | 30/162 |

FOREIGN PATENT DOCUMENTS

| | | | |
|---|---|---|---|
| 462308 | 1/1950 | Canada | 30/162 |

*Primary Examiner*—E. R. Kazenske
*Assistant Examiner*—Willmon Fridie
*Attorney, Agent, or Firm*—Fulwider, Patton, Rieber, Lee & Utecht

[57] ABSTRACT

An elongated blade formed on its opposite ends with points and including first, second and third pairs of bores disposed respectively at one end of such blade, centrally on such blade and at the opposite end of such blade. A handle is received telescopically on the blade and includes a latch for selectively engaging the respective bores to selectively latch the handle centrally with both points exposed for convenient throwing or for latching at one or the other of the opposite ends of the blade.

13 Claims, 9 Drawing Figures

DOUBLE ENDED THROWING KNIFE

BACKGROUND OF THE INVENTION

1. Field of the Invention

The present invention relates generally to knives and, more particularly, to a throwing knife.

2. Description of the Prior Art

The art of throwing knives at a target in a manner which will allow the knife to strike the target point first to positively embed in the target has, in the past, required great skill and training. The success of a knife thrower has depended heavily on his proficiency with the shape and configuration of the knife having only a minor contribution to his performance. Efforts to improve the equipment used in knife throwing has generally led only to the design and construction of knives having improved balance but always formed with only a single point. Consequently, a need exists for a double ended knife which may be conveniently thrown by the user thereby nearly doubling the probability of the knife striking a target point first.

Knives having double ended blades are known in the art but such knives are typically constructed of a combination of handle and blade configuration which results in only one point of the blade being exposed from the handle at a time. A knife of this type is shown in U.S. Pat. No. 373,580. A knife of this type, while being satisfactory for its intended purpose, suffers the shortcoming that both ends of the blade are not simultaneously exposed from the opposite ends of the handle to enable a user to grasp the handle for throwing of the knife with both blade points extended.

Surgical scalpels have been proposed which incorporate a knife blade selectively extendable from a handle. A scalpel of this type is shown in U.S. Pat. No. 3,906,626. Such scalpels, however, fail to incorporate double ended blades for penetrating a target when thrown.

SUMMARY OF THE INVENTION

The double ended throwing knife of the present invention is characterized by a blade formed on its opposite ends with respective blade points and having multiple latch elements spaced therealong for selective engagement with a latch incorporated in a handle telescoped over the blade. Consequently, the handle may be latched in a position located centrally on the length of the blade for grasping and throwing of the knife with both ends exposed. Alternatively, the handle may be shifted longitudinally to one end of the blade to shroud one point while exposing the cutting edge and other point of the blade.

Other objects and features of the invention will become apparent from consideration of the following description taken in connection with the accompanying drawing.

DESCRIPTION OF THE PREFERRED EMBODIMENTS

Figure 1:
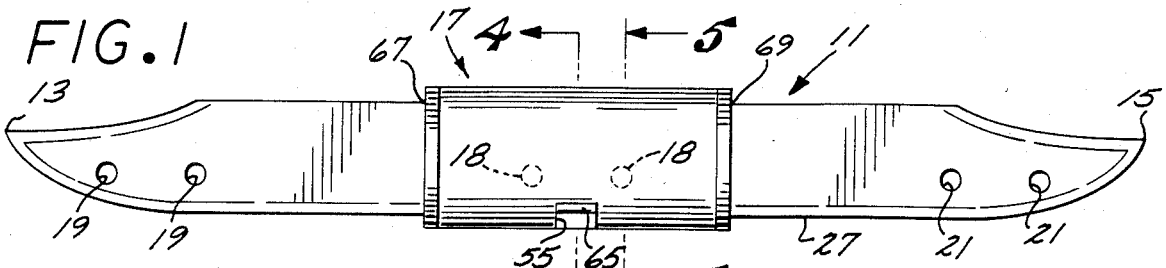
FIG. 1 is a front view of a double ended throwing knife embodying the present invention.
Figure 2:
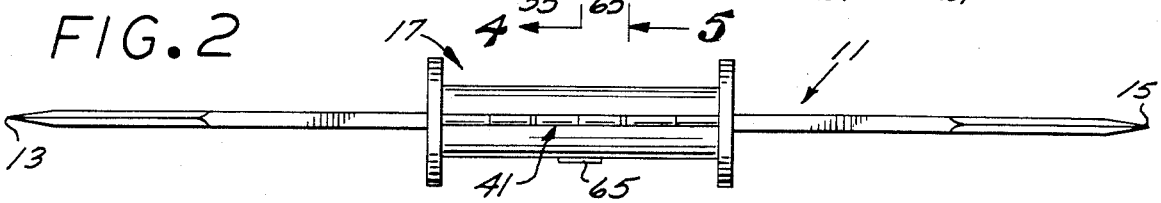
FIG. 2 is a top view of the throwing knife shown in FIG. 1.
Figure 3:
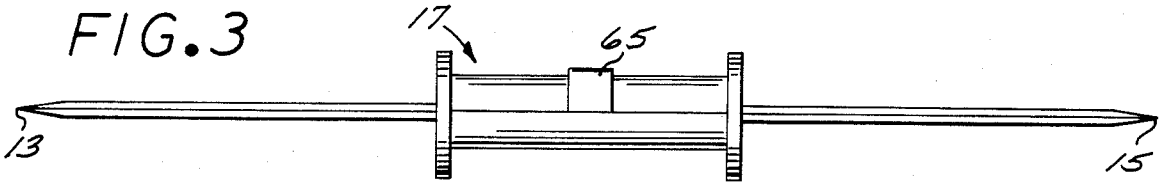
FIG. 3 is a bottom view of the throwing knife shown in FIG. 1.
Figure 4:
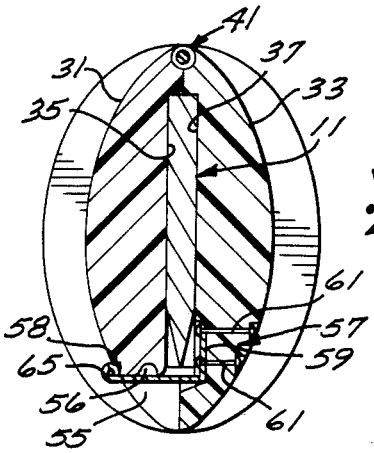
FIG. 4 is a transverse sectional view, in enlarged scale, taken along the line 4—4 of FIG. 1.
Figure 9:
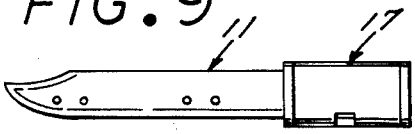
FIG. 9 is a front view, in reduced scale, of the knife shown in FIG. 1 but depicting the handle shifted to one end thereof.

Referring to FIGS. 1 and 4, the double ended throwing knife of the present invention includes, generally, an elongated blade 11 formed on its opposite ends with points 13 and 15 and having a handle 17 telescoped thereover. Formed centrally along the length of the blade 11 are a pair of transverse bores 18 and formed at the opposite ends of such blade are respective pairs of bores 19 and 21. The handle 17 includes a pair of transversely projecting latch pins 25 which selectively engage the bores 18, 19 or 21 to selectively latch the handle 17 centrally on the blade 11 or at one end or the other thereof (FIG. 9).

The opposite ends of the blade 11 are of conventional configuration and such blade is formed along the entire one side thereof with a cutting edge 27.

The handle 17 is intended to be shifted longitudinally along the blade 11, it being important only that it incorporate a passage for receipt of such blade and include a latch which will selectively engage the bores 18, 19 and 21. The handle 17 may be made out of any desirable material, such as wood, hard rubber or plastic. The embodiment shown in FIGS. 1–6 incorporates a handle constructed of plastic and is made up of two side by side sections 31 and 33 which cooperate together to produce the exterior contour of the handle. The general configuration of the sections 31 and 33 are such that they are essentially mirror images of one another and are formed on their interior sides with respective rectangular cutouts 35 and 37 which cooperate together to form a cavity which snuggly fits the body of the blade 11.

Figure 5:
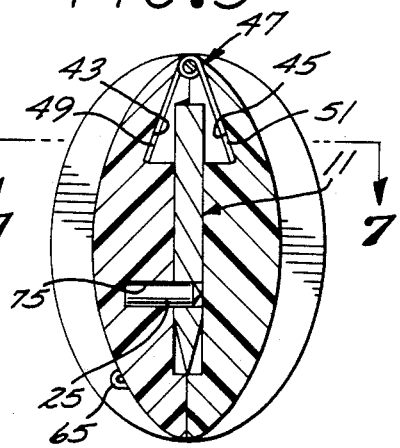
FIG. 5 is a transverse sectional view, in enlarged scale, taken along the line 5—5 of FIG. 1.

The sections 31 and 33 are coupled together along their top side by means of a piano style hinge 41. Referring to FIG. 5, formed within the body of the handle adjacent the hinge 41 is a triangular shaped interior cavity defined by confronting cavities 43 and 45 formed in the opposite sections 31 and 33. Mounted on the hinge pin of the hinge 41 is a torsion spring 47 having oppositely disposed angular legs 49 and 51 which nest against the ouside walls of the respective cavities 43 and 45 to bias the sections 31 and 33 away from one another about the pivot axis of the hinge 41.

Referring to FIG. 4, one handle section 31 has a portion of its lower extremity cut away to form a downwardly opening notch 55 having a flat top wall. Formed in the top wall of the notch 55 are a pair of downwardly opening laterally spaced apart lock grooves 56 and 58.

A lock clip, generally designated 57, is formed with a vertically extending base plate 59 which is secured to the interior of the other handle section 33 by means of fasteners 61. The clip 57 turns laterally outwardly to overlie the groove 56 and is formed on its extremity with a bead 65 which is selectively received in either the notch 58 or 56 to selectively lock such handle in its closed and latched position shown in FIG. 4 or in its unlatched position shown in FIG. 6.

The opposite ends of the handle 17 are formed with radial flanges 67 and 69 which are spaced longitudinally apart a distance sufficient to afford a comfortable grasp on the body of the handle 17.

Figure 6:
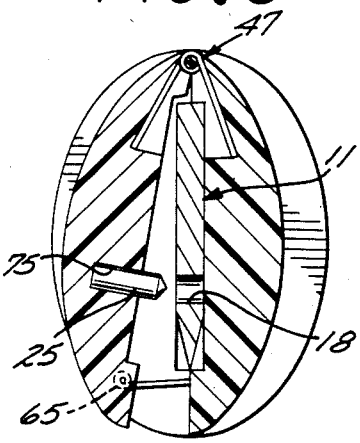
FIG. 6 is a view similar to FIG. 5 but showing the handle in an open position.
Figure 7:
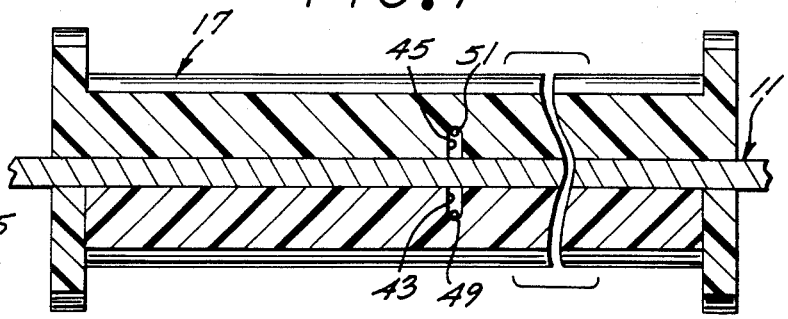
FIG. 7 is a transverse sectional view similar to FIG. 4 but of a second embodiment of the double ended throwing knife of the present invention.

Referring to FIGS. 5 and 6, the interior of the handle section 31 is formed with a pair of longitudinally spaced apart bores 75 for making an interference fit with the anchor ends of the respective latch pins 25. The latch pins 25 are of a length sufficient to bottom out in the bore 75 and to project therefrom a distance sufficient to positively engage the selected bores 18, 19 and 21 in the blade 11 without projecting beyond the opposite side of the blade.

It will be appreciated that the latching arrangement need not be limited to a bore and pin arrangement exactly as disclosed but may be of any substantially equivalent design, such as, for example, latching pins that are biased to their latching arrangement with the bores in the blade such that they are automatically projected into the latching bores upon registration therewith. A retractor may be incorporated in the handle for actuation by the operator to selectively retract such pins from their telescopical engagement with the blade bores. Other equivalent arrangements are the provision of a frictional latch which frictionally grips the blade or a latching dog mounted from the handle which will selectively latch at various locations with the handle and which is then actuatable to disengage from latching engagement with such blade for shifting thereof longitudinally relative to the handle.

In operation, when the double ended knife of the present invention is to be used as a throwing knife, the handle 17 is positioned centrally on the blade as viewed in FIG. 1. The user may then grasp the handle 17 and throw the knife in an end over end fashion to propel it toward its target. It has been discovered that with only a relatively modest amount of skill and training, a rather inexperienced knife thrower may rapidly achieve a level of skill enabling him to exhibit a great degree of proficiency in striking the target with one or the other of the points 13 or 15 on nearly every throw.

When the knife is to be used as a work knife, such as a carving or skinning knife, the projecting extremity of the latch 57 forming the bead 65 (FIG. 4) may be pressed downwardly with the user's thumb to thus disengage the bead 65 from the notch 58 thus freeing the lower extremity of the handle section 31 to be urged outwardly away from the other handle section 33 under the influence of the spring 47. The bottom portion of the handle section 31 will thus spring outwardly until the bead 65 engages in the release notch 56 thereby limiting further rotation of the section 31 relative to the hinge 41. At this point, the latch pins 25 are disengaged from the latch holes 18 and the handle 17 may then conveniently be shifted on the blade 11 to an end position, for instance overlying the point 15 with the latch pins 25 aligned with the latch bores 21. The handle section 31 may then be pressed closed against the influence of the torsion spring 47 thus causing the latch bead 65 to reengage the groove 58 (FIG. 4). The knife is then in the configuration shown in FIG. 9 so the user may conveniently grasp the handle 17 and use nearly the entire length of the cutting edge 27. It will be appreciated to those skilled in the art that the same procedure may be involved in shifting the handle 17 entirely to the opposite end of the blade 11 to cover the point 13. Consequently, if desired, one end of the blade may be employed for common tasks, such as carving or cutting animal bones while the cutting edge at the opposite end of such blade is employed only for tasks requiring especially keen edges, such as skinning.

Figure 8:
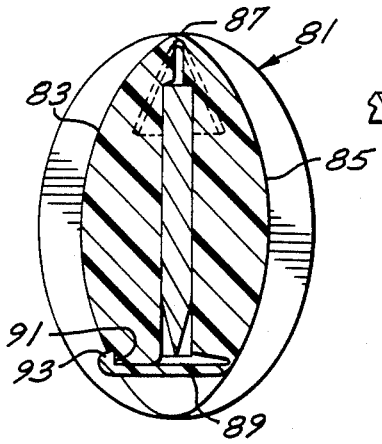
FIG. 8 is a longitudinal sectional view taken along the line 7—7 of FIG. 5.

The throwing knife shown in FIG. 8 is essentially the same as that shown in FIG. 1 except that the handle, generally designated 81, is constructed of one integral piece of plastic and formed with the opposite sections 83 and 85 connected together at their upper extremities by means of a thin section of the parent plastic to thus form a living hinge 87. The medial portion of the bottom of the sections 83 and 85 are cut away to form a latch area and a latch tab 89 projects from the section 85 to be disposed in overlying relationship with respect to the section 83 and is formed with a locking lip 91 received in a locking notch 93 formed in such section 83. Consequently, when the handle 81 is to be shifted from location to location on the blade 11, the lip 91 may be pressed downwardly to disengage the notch 93 to free the bottom portion of the sections 83 and 85 for rotation about the hinge 87 to thus free the blade for shifting longitudinally relative to the handle. In the case of both the knives of FIGS. 1 and 8, the handles 17 and 81 may conveniently be removed entirely from the blades for convenient and thorough washing of the blades.

From the foregoing it will be apparent that the double ended throwing blade of the present invention affords a knife which is sturdy in construction, economical to manufacture and which enables relatively unskilled personnel to achieve a high degree of proficiency in knife throwing with only a minimum amount of experience.

Various modifications and changes may be made with regard to the foregoing detailed description with departing from the spirit of the invention.

I claim:

1. A double ended throwing knife comprising:

an elongated double ended blade formed centrally with a shank portion and at its opposite ends with first and second point portions equally balanced with respect to one another;

a first latch element formed on said first point portion;

a second latch element formed on said shank portion;

a handle received telescopically over said blade for telescoping from a throwing position on said shank portion to a carving position over said first point portion; and releasable latch means mounted on said handle for selectively engaging and releasably latching with said first and second latch elements whereby said latch means may be released and said handle telescoped along said blade to said central throwing position on said shank to expose both point portions of said blade and said latch means latched to engaged with said first latch element so the user may grasp said handle to throw said knife toward a target with both ends exposed and, alternatively, said latch means may be released and said handle telescoped along said blade to said carving position over said first point portion leaving said shank and second point portion exposed therefrom.

2. A double ended throwing knife according to claim 1 wherein:

said blade includes third latch elements on said second point portion of said blade for releasable engagement by said latch means to selectively lock said handle at said second point portion of said blade.

3. A double ended throwing knife according to claim 1 wherein:

said handle is formed on its opposite ends with laterally outwardly projecting flanges.

4. A double ended throwing knife according to claim 1 wherein:

said handle includes first and second semicylindrically shaped sections cooperating together to form a central passage for receipt of said blade;

a hinge connecting said first and second sections together along one side thereof; and a lock for selectively locking said handle sections together.

5. A double ended throwing knife according to claim 1 wherein:

said blade includes first and second bores defining said first and second latch elements; and said latch means includes a pin for selective receipt in said bores.

6. A double ended throwing knife according to claim 4 wherein:

said first section is formed on its side opposite said one side with an outwardly opening groove; and said latch means includes a resilient tab projecting from said second section and formed with a laterally projecting bead configured and arranged to be biased into said groove when said first and second sections are closed together.

7. A double ended throwing knife according to claim 4 wherein;

said blade includes first and second bores defining said first and second latch elemtns; and said latch means includes a pin for selective receipt in said bores when said sections are closed on each other.

8. A double ended throwing knife according to claim 4 wherein:

said sections are constructed of flexible material and are connected together along said one side by a thin layer of said material to form a living hinge.

9. A double ended throwing knife according to claim 4 wherein:

said handle includes a spring interposed between said sections to bias said sections rotationally apart about said hinge.

10. A double ended throwing knife according to claim 6 wherein:

said first section is formed with a second outwardly opening groove spaced laterally of said first mentioned groove for selective receipt of said bead.

11. A double ended throwing knife according to claim 8 wherein:

said first section is formed with notch disposed at the side theeof opposite said one side; and said second section has formed integral therewith a leaf style spring overlying said notch when said sections are closed together and formed with a latching lip releasably received in said notch.

12. A double ended throwing knife as set forth in claim 1 wherein:

said handle is formed with a through opening which is configured to closely fit the cross sectional configuration of said shank to guide longitudinal sliding therethrough of said blade.

13. A double ended throwing knife comprising:

an elongated double ended blade formed centrally with a shank and at its opposite ends with first and second point portions equally balanced with respect to the longitudinal center of said blade;

a handle received telescopically over said blade for sliding from a central throwing position over said shank to a carving position covering said first point and leaving said shank and said second point position exposed;

a releasable latch mounted on said handle and selectively operable to release said handle from said blade for telescoping therealong and further operable when said handle is in said central throwing position to releasably lock said handle on said blade at said throwing position to leave both ends of said blade exposed so the user may grasp said handle to throw said knife with said ends exposed from the opposite ends thereof; and said latch also being operable when said handle is in said carrying position to engage said blade and lock said handle in said carving position covering said one blade portion and leaving said shank and second blade portion exposed for carving.

* * * * *